US010730321B2

(12) United States Patent
Lee

(10) Patent No.: US 10,730,321 B2
(45) Date of Patent: Aug. 4, 2020

(54) CUTTER OF PRINTER

(71) Applicant: Il-Bok Lee, Gwangmyeong-si (KR)

(72) Inventor: Il-Bok Lee, Gwangmyeong-si (KR)

( * ) Notice: Subject to any disclaimer, the term of this patent is extended or adjusted under 35 U.S.C. 154(b) by 945 days.

(21) Appl. No.: 14/400,897

(22) PCT Filed: Dec. 20, 2013

(86) PCT No.: PCT/KR2013/011945
§ 371 (c)(1),
(2) Date: May 6, 2015

(87) PCT Pub. No.: WO2014/098515
PCT Pub. Date: Jun. 26, 2014

(65) Prior Publication Data

US 2015/0251457 A1 Sep. 10, 2015

(30) Foreign Application Priority Data

Dec. 21, 2012 (KR) ..... 10-2012-0150822

(51) Int. Cl.
*B41J 11/70* (2006.01)
*B26D 1/06* (2006.01)
(Continued)

(52) U.S. Cl.
CPC ..... *B41J 11/70* (2013.01); *B26D 1/065* (2013.01); *B26D 1/085* (2013.01); *B26D 5/14* (2013.01);
(Continued)

(58) Field of Classification Search
CPC ..... B26D 1/065; B26D 1/08; B26D 1/085; B26D 5/14; B26D 1/06; B26D 5/16;
(Continued)

(56) References Cited

U.S. PATENT DOCUMENTS 6,109,154 A * 8/2000 Miyatsu et al. ..... B26D 1/085 83/202
6,152,007 A * 11/2000 Sato ..... B26D 1/0006 83/202
(Continued)

FOREIGN PATENT DOCUMENTS

EP 0 798 254 A2 * 10/1997 ..... B41J 11/703
EP 1 063 094 A1 * 12/2000 ..... B47J 11/703
(Continued)

*Primary Examiner* — Clark F Dexter
(74) *Attorney, Agent, or Firm* — DeLio Peterson & Curcio LLC; Thomas E. Ciesco

(57) ABSTRACT

A cutter of a printer including a rectangular housing in which a paper feeding roller and a fixed blade are integrally coupled to each other. The cutter includes a movable member corresponding to a plate-shape member having a slot at the center of a body provided at an upper side of the housing corresponding to the fixed blade such that a movable blade at one side is engaged with the fixed blade while being selectively reciprocally moved. The cutter includes a motor within the housing generating a forward or reverse driving force, a gear unit including a driving gear installed in a driving shaft of the motor, a reduction gear engaged with the driving gear and an idle gear engaged with a shaft gear. The cutter includes an eccentric plate coupled to an upper surface of the driven gear for applying external force for reciprocal motion to the movable member.

6 Claims, 9 Drawing Sheets

(51) Int. Cl.

| | |
|---|---|
| ***B26D 1/08*** | (2006.01) |
| ***B26D 5/14*** | (2006.01) |
| ***B26D 5/16*** | (2006.01) |

(52) U.S. Cl.
CPC ..... *B26D 5/16* (2013.01); *Y10T 83/8748* (2015.04); *Y10T 83/8841* (2015.04); *Y10T 83/8843* (2015.04); *Y10T 83/8844* (2015.04); *Y10T 83/8854* (2015.04)

(58) Field of Classification Search
CPC ..... B41J 11/70; B41J 11/703; B41J 11/706; Y10T 83/8748; Y10T 83/8821; Y10T 83/8824; Y10T 83/8825; Y10T 83/8827; Y10T 83/8841; Y10T 83/8843; Y10T 83/8844; Y10T 83/8854
USPC ..... 83/613, 615–617, 627–629, 636, 563
See application file for complete search history.

(56) References Cited

U.S. PATENT DOCUMENTS

| | | | | |
|---|---|---|---|---|
| 6,405,625 | B1 * | 6/2002 | Nomura et al. ..... | B41J 15/042 83/214 |
| 6,786,125 | B2 * | 9/2004 | Imai ..... | B41J 11/70 192/48.92 |
| 8,651,002 | B2 * | 2/2014 | Sato ..... | B26D 1/085 83/582 |
| 8,834,048 | B2 * | 9/2014 | Mochida et al. ..... | B41J 11/703 400/621 |
| 2005/0132859 | A1 * | 6/2005 | Hunag ..... | B26D 5/16 83/628 |
| 2012/0027496 | A1 * | 2/2012 | Mochida et al. .... | B26D 1/0006 400/621 |

FOREIGN PATENT DOCUMENTS

| | | | | |
|---|---|---|---|---|
| JP | 2009-196209 | * | 9/2009 | |
| JP | 2010-549 | * | 1/2010 | |
| KR | 10-0912461 | * | 8/2009 | ..... B41J 11/66 |

* cited by examiner

[FIG. 1]
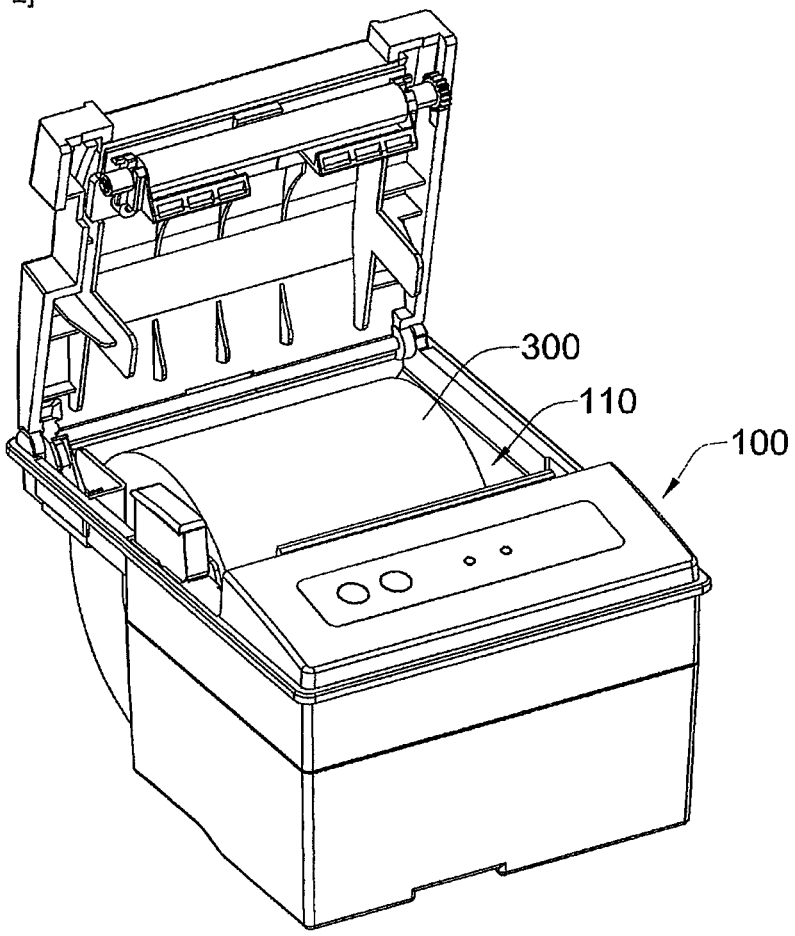
[FIG. 2]
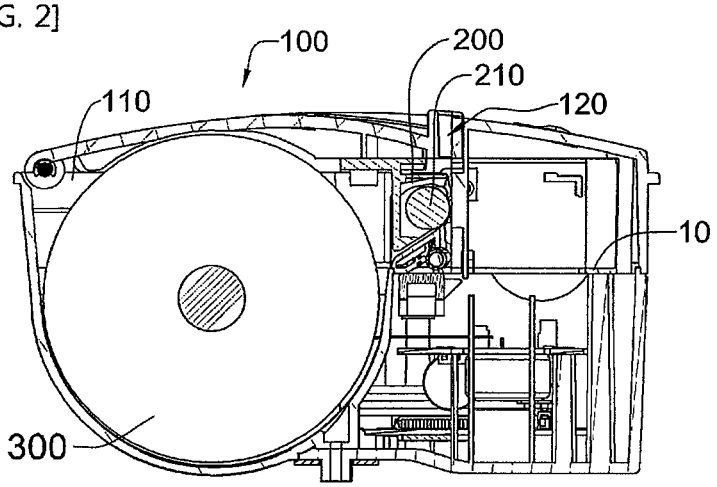

[FIG. 3]
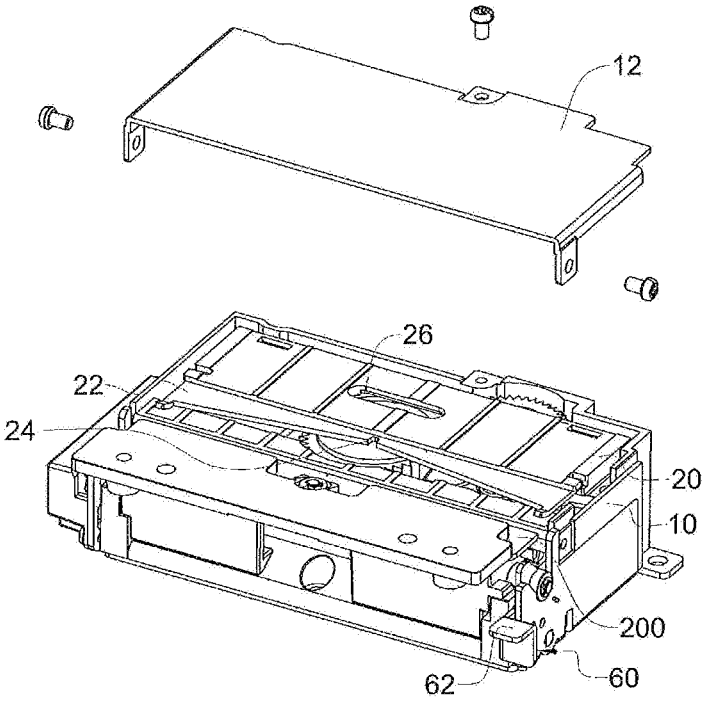

[FIG. 4]
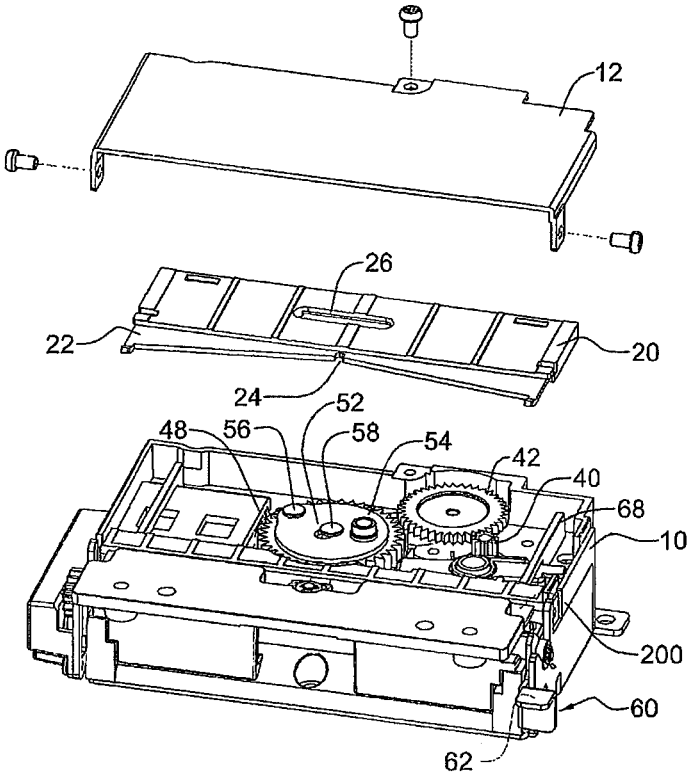
[FIG. 5A]
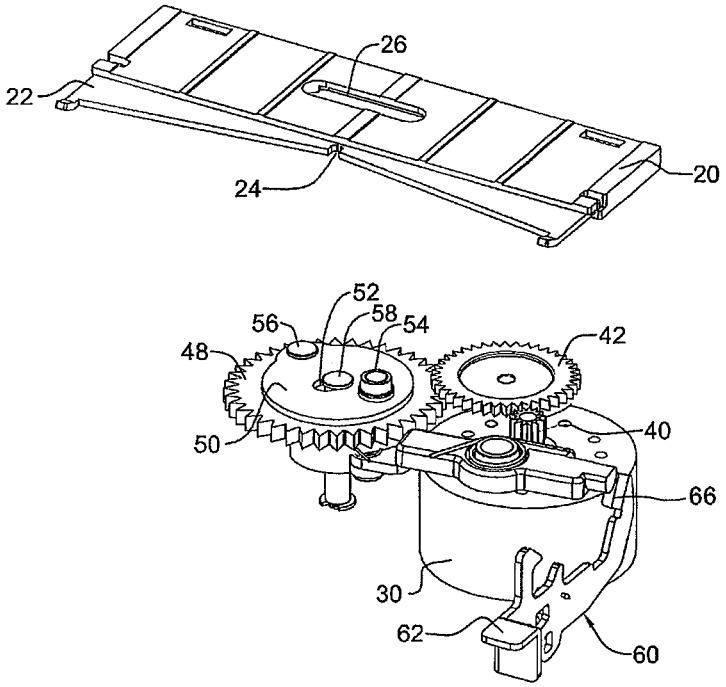

[FIG. 5B]
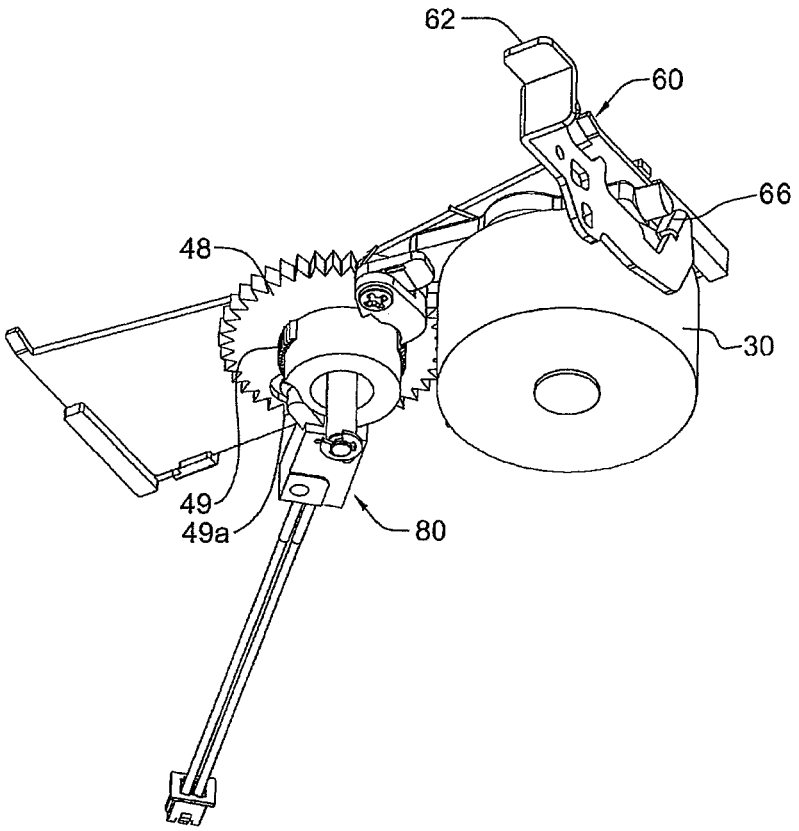

[FIG. 6A]
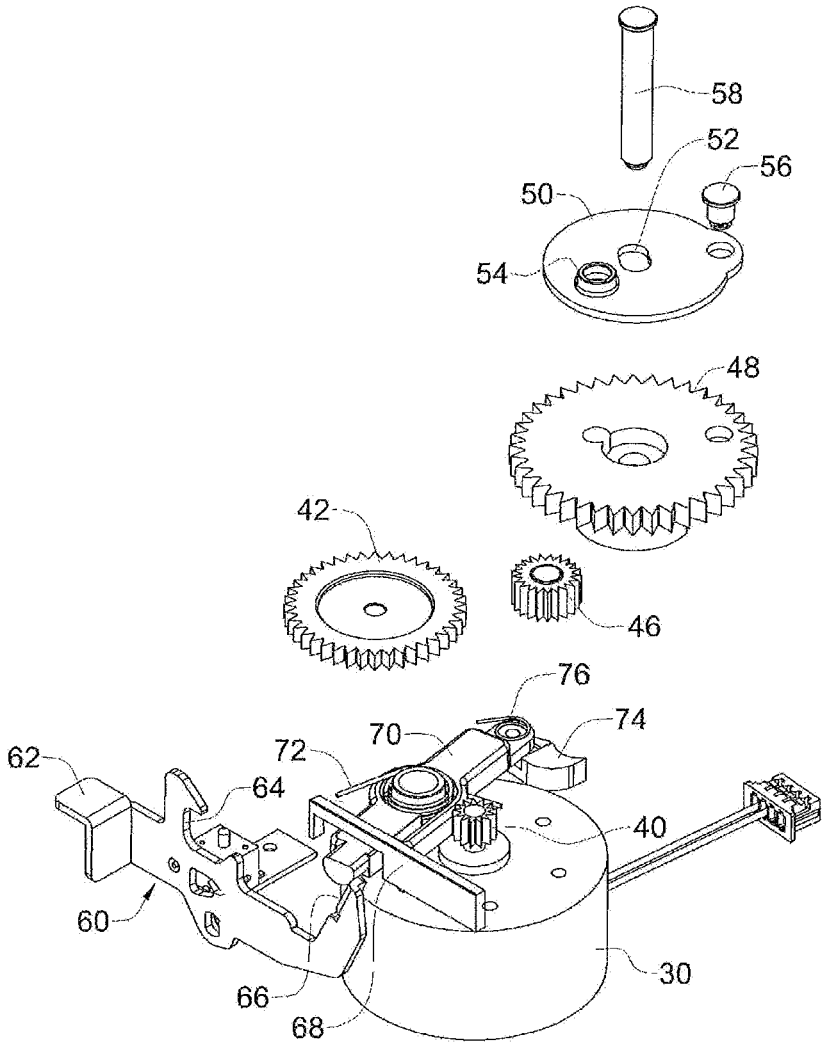

[FIG. 6B]
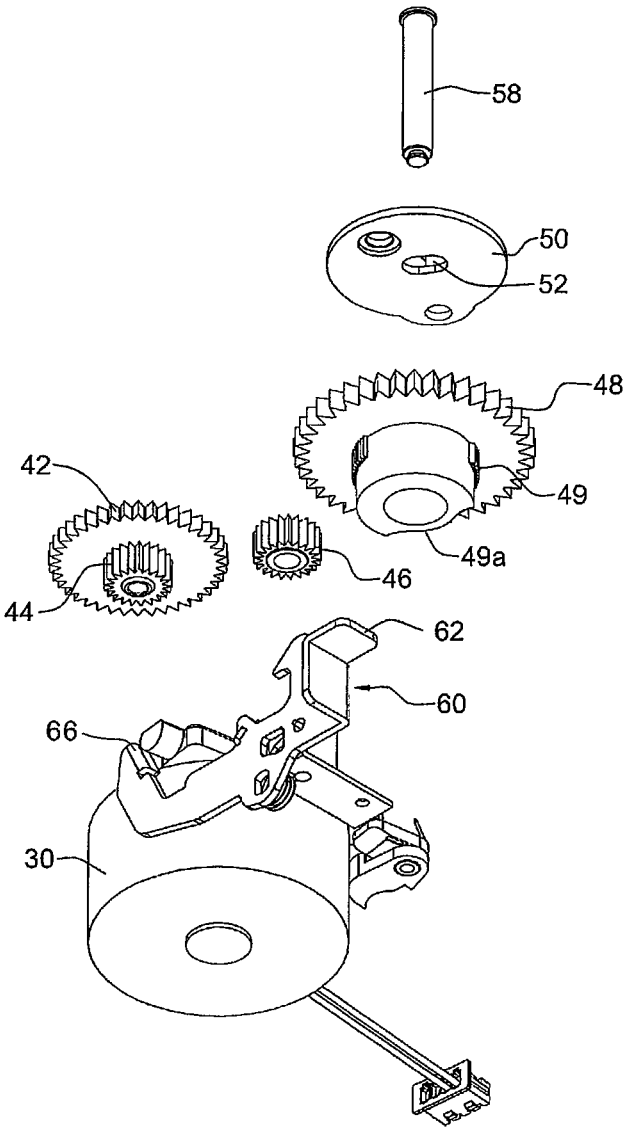

[FIG. 7]
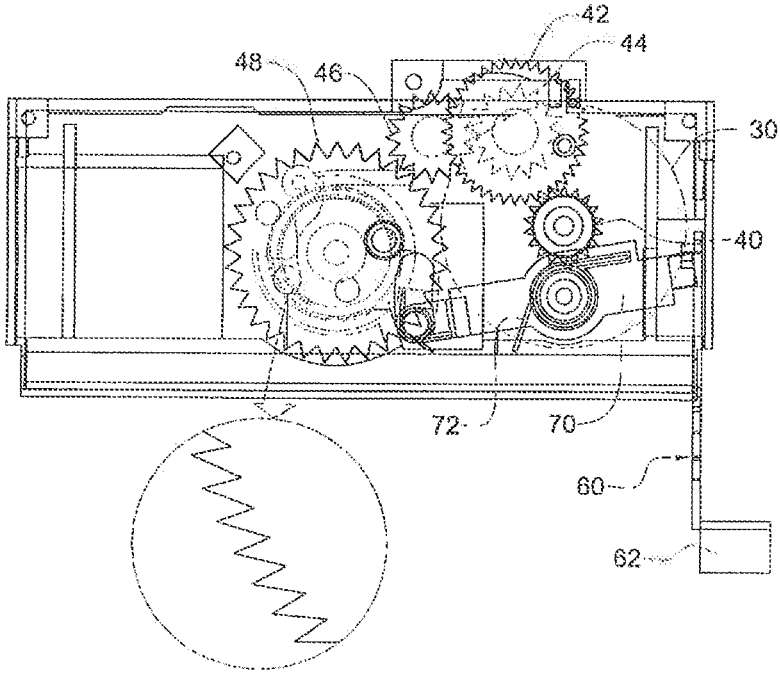
[FIG. 8A]
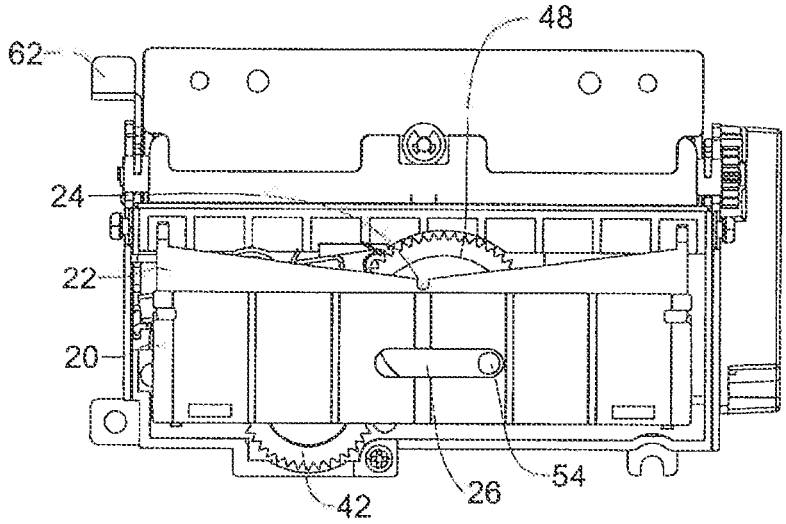

[FIG. 8B]
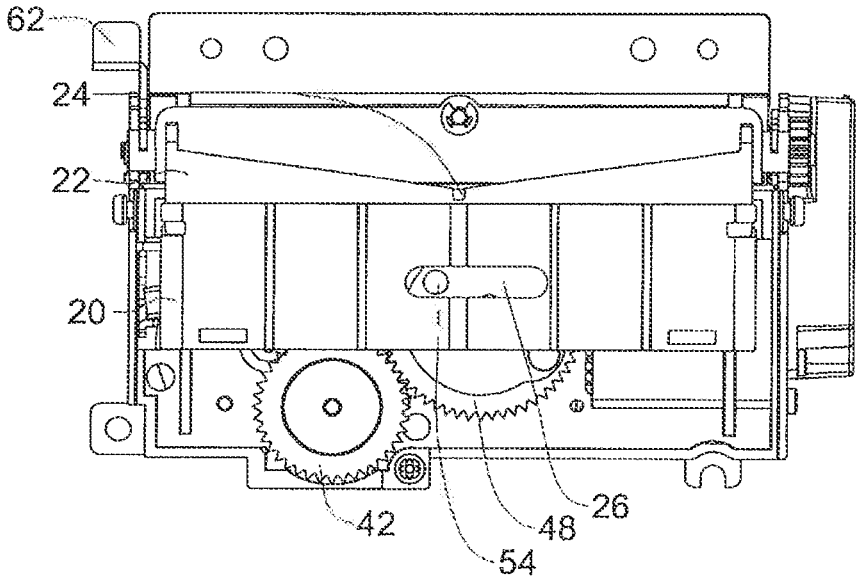
[FIG. 9A]
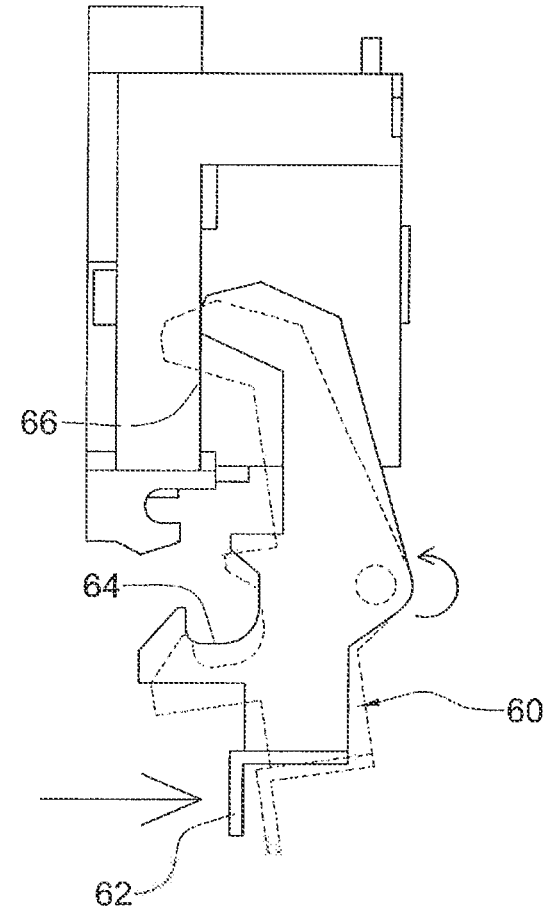

[FIG. 9B]
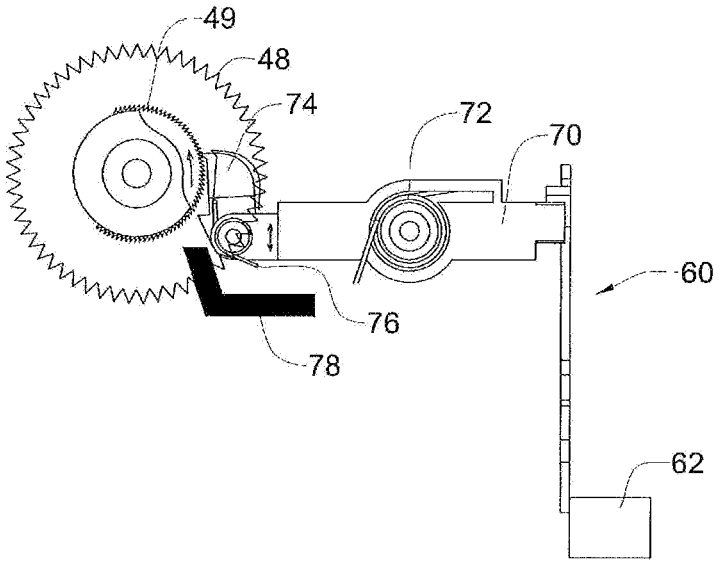

CUTTER OF PRINTER

BACKGROUND OF THE INVENTION

1. Field of the Invention

The present invention relates to a cutter structure of a printer, and more particularly to a cutter structure of a printer which can effectively cut paper, such as receipts, slips, and labels which are output by the printer, and simply solve jamming of paper.

2. Description of Related Art

In general, a printer is an apparatus connected to various electronic devices such as computers, for printing and outputting data stored in the devices on paper of a predetermined size.

In recent years, as mobile communication terminal devices such as smartphones, tablet PCs, and PDAs or portable terminal devices such as laptop computers, as well as PCs, have become public, various printers connected to the terminal devices, for simply printing data stored in the terminal devices, are being widely used.

The printer includes a receiving part, in which paper for printing is accommodated, is provided in a body having a predetermined shape to be opened and closed by the medium of a cover; a discharge opening, through which the accommodated paper is discharged, is formed at one side of the cover; and a printing module for printing data on the paper, a paper feeding module for supplying the paper, and a cutting module for cutting the paper are installed at a point adjacent to the discharge opening.

Then, in the configuration of the cutting module, a fixed blade is installed at one side of the discharge opening together with a paper feeding roller to be attached and detached, and a movable blade is installed at a portion corresponding to the fixed blade to be reciprocally moved through a mechanism of a specific structure.

Technical Problem

However, in the cutter structure provided in a printer according to the related art, because the mechanism for reciprocating the movable blade, the movable blade, and the mechanism for releasing printer paper when the printer paper is jammed form a complex structure, many components are required when the cutting module is manufactured, the assembly process is complex, manufacturing costs increase, and productivity is lowered.

In particular, because the structure for releasing the movable blade when the movable blade is stuck in the printer according to the present invention requires a separate button, the user experiences inconvenience and an aesthetic feeling of the outer appearance of the printer is lowered.

The present invention has been made in an effort to solve the above-mentioned problems, and an object of the present invention is to provide a cutter structure of a printer, which is designed such that a cutting module for cutting printer paper has a mechanism of a specific structure in a printer, whereby paper can be efficiently cut and a problem caused by an unintended engagement of the cutter or jamming of printer paper can be simply solved by manipulating an existing lever.

SUMMARY OF THE INVENTION

In accordance with an aspect of the present invention, there is provided a cutter of a printer comprising: a rectangular parallelepiped housing in which a paper feeding roller and a fixed blade integrally coupled to each other are detachably mounted to an upper portion of one side thereof; a movable member corresponding to a plate-shape member having a slot at the center of a body thereof and provided at an upper side of the housing corresponding to the fixed blade such that a movable blade at one side thereof is engaged with the fixed blade while being selectively reciprocally moved; a motor fixedly installed within the housing, for receiving a control signal and generating a forward or reverse driving force; a gear unit including a driving gear installed on a driving shaft of the motor, a reduction gear engaged with the driving gear, an idle gear engaged with a shaft gear at a lower portion of the reduction gear, and a driven gear engaged with the idle gear to interlock with the idle gear and in which a guide boss is coupled to a central portion thereof; and an eccentric plate having a substantially disk shape, coupled to an upper surface of the driven gear, having a slot-shaped guide hole at the center thereof such that the guide boss of the driven gear passes through the guide hole, and having a coupling boss coupled to the slot of the movable member, for applying an external force for reciprocal motion thereof to the movable member at one side of the guide hole.

Preferably, the guide boss of the driven gear is moved to one or an opposite side of the guide hole of the eccentric plate as the motor is rotated forwards or reversely, and a movement distance of the movable member is controlled according to an interval between the guide boss moved in the slot-shaped guide hole and the coupling boss to which the movable member is coupled.

Preferably, the moveable blade returns through manipulation of a lever at one side of the housing when the movable blade of the movable member is unintendedly engaged with the fixed blade, and a return gear having saw-toothed gear teeth only at a portion of an outer peripheral surface thereof is formed on a lower side of the driven gear to interlock with the driven gear, a pressing piece having a sharp end attached to the return gear by the medium of an attaching spring is installed at one side of an outer peripheral surface of the return gear, a pressing piece is connected to one end of a horizontally rotated bar-shaped rotation member, and the rotation member receives a return force by the medium of the return spring such that an opposite end of the rotation member is engaged with a pressing part formed at an end of the lever so as to be inclined.

More preferably, a guide wall having an L-shaped planar shape, for guiding the pressing piece such that the pressing piece is attached to the return gear when the rotation member is rotated, is formed at a connection point of the rotation member and the pressing piece.

Furthermore, a lower portion of the return gear does not have a gear portion over an entire outer peripheral surface thereof and a portion of the outer peripheral surface of the return gear is removed to form a detection part, and wherein a detection switch for detecting a rotation position of the return gear and transmitting a signal is installed at a portion of the outer peripheral surface of the return gear.

Advantageous Effects

According to the present invention, because a printer connected to various terminal devices including smartphones, tablet PCs, PDAs, and laptop computers is designed such that a mechanism for cutting printer paper has a specific structure, an operation of cutting printer paper can be efficiently performed while the cutting module is stably controlled when the printer is used.

In addition, when the cutter is unintendedly engaged or printer paper is jammed during an operation of the printer, the problem can be very simply solved by manipulating a lever provided at one side of the housing, and accordingly, convenience of the user can be improved.

BRIEF DESCRIPTION OF THE DRAWINGS

FIG. 1 is a perspective view showing an entire configuration of a printer to which a cutter structure of a printer according to the present invention is applied;

FIG. 2 is a sectional view showing the entire configuration of the printer to which the cutter structure of a printer according to the present invention is applied;

FIG. 3 is a perspective view showing an external appearance of a cutting module to which the cutter structure of a printer according to the present invention is applied;

FIG. 4 is a partially exploded perspective view showing a configuration of the cutting module to which the cutter structure of a printer according to the present invention is applied;

FIGS. 5A and 5B are upper and lower perspective views showing an internal configuration of the cutting module to which the cutter structure of a printer according to the present invention is applied;

FIGS. 6A and 6B are upper and lower exploded perspective views showing the internal configuration of the cutting module to which the cutter structure of a printer according to the present invention is applied;

FIG. 7 is a plan view showing the configuration of the cutting module to which the cutter structure of a printer according to the present invention is applied;

FIGS. 8A and 8B are views showing an operational state of a movable member through the cutter structure of a printer according to the present invention; and FIGS. 9A and 9B are views showing an operational state of a lever through the cutter structure of a printer according to the present invention.

DESCRIPTION OF THE PREFERRED EMBODIMENT(S)

Hereinafter, the present invention will be described in detail with reference to the accompanying drawings.

FIG. 1 is a perspective view showing an entire configuration of a printer to which a cutter structure of a printer according to the present invention is applied. FIG. 2 is a sectional view showing the entire configuration of the printer to which the cutter structure of a printer according to the present invention is applied. FIG. 3 is a perspective view showing an external appearance of a cutting module to which the cutter structure of a printer according to the present invention is applied. FIG. 4 is a partially exploded perspective view showing a configuration of the cutting module to which the cutter structure of a printer according to the present invention is applied. FIGS. 5A and 5B are upper and lower perspective views showing an internal configuration of the cutting module to which the cutter structure of a printer according to the present invention is applied. FIGS. 6A and 6B are upper and lower exploded perspective views showing the internal configuration of the cutting module to which the cutter structure of a printer according to the present invention is applied. FIG. 7 is a plan view showing the configuration of the cutting module to which the cutter structure of a printer according to the present invention is applied. FIGS. 8A and 8B are views showing an operational state of a movable member through the cutter structure of a printer according to the present invention. FIGS. 9A and 9B are views showing an operational state of a lever through the cutter structure of a printer according to the present invention.

The cutter structure of a printer according to the present invention drives a printer more smoothly and provides convenience for a user by designing a cutting module for cutting printer paper of a printer connected to various terminal devices and a configuration for releasing unintended engagement of a cutter or insertion of printer paper such that the cutting module and the configuration have a specific structural mechanism.

To this end, in the cutter structure of a printer according to the present invention, a specific structural cutting module for cutting printer paper 300 is configured in a rectangular parallelepiped housing 10 in which a paper feeding roller 210 and a fixed blade 200 are detachably mounted to an upper portion of one side of a body thereof as an integral module and a means for releasing insertion of printer paper and engagement of a cutter are formed to integrally interlock with a lever 60.

As known, printer paper 300 on which a printing operation is completely performed by the printer 100 is discharged to the outside of the printer by a predetermined length and then a cutting operation is performed through a cutting module.

To this end, a discharge opening 120 through which paper is discharged is formed on one side of a receiving part 110 in which the printer paper 300 wound in the form of a roll in the printer 100 and an integral module including the paper feeding roller 210 for discharging the printer paper 300 and the fixed blade 200 for a cutting operation is provided on a side of the discharge opening 120 such that the integral module can be selectively mounted and detached through manipulation of the lever 60 having a substantially hook-shaped latching recess 64.

Meanwhile, according to the present invention, the structure for cutting printer paper 300 is a movable blade 22 that reciprocally moves toward the fixed blade 200 and includes a motor 30 fixedly installed within the housing 10, a gear unit including a plurality of gears, an eccentric plate 50, and a movable member 20 for converting rotation of the eccentric plate 50 to linear motion to reciprocally move the movable blade 22 toward the fixed blade 200.

The motor 30 is a DC motor fixed to one side of an inside of the housing 10, and is configured to generate a forward or reverse driving force according to a control signal from a controller (not shown).

The gear unit is configured such that a plurality of gears are engaged with each other to transfer a driving force from the motor 30 to the eccentric plate 50, and includes a driving gear 40 fixedly installed in a driving shaft of the motor 30, a reduction gear 42 engaged with the driving gear 40 to be rotated, for reducing rotating force, an idle gear 46 engaged with a shaft gear 44 installed on a rotary shaft of the reduction gear 42, and a driven gear 48 engaged with the idle gear 46 to interlock with the idle gear 46.

A guide boss 58 passes through the center of an upper surface of the driven gear 48 such that the eccentric plate 50 may move.

The eccentric plate 50 has a substantially disk shape, and one side of an outer peripheral surface of the eccentric plate 50 protrudes and expands such that the corresponding portion is engaged with an upper surface of the driven gear 48 while being rotatable through a hinge pin 56 and a slot-shaped guide hole 52 is formed at a central portion of the body of the eccentric plate 50 such that the guide boss 58 coupled to the driven gear 48 passes through the guide hole 52.

A coupling boss 54 coupled to a slot 26 of the movable member 20, for applying an external force for reciprocal motion to the movable member 20 protrudes from a location adjacent to the guide hole 52.

The movable member 20 engaged with the coupling boss 54 of the eccentric plate 50, for reciprocal motion thereof includes a plate in which the slot 26 is formed at the center of the body thereof, and is provided at an upper side of the housing 10 corresponding to the fixed blade 200 while the movable blade 22 is formed at a front end thereof to selectively perform reciprocal motion.

A cutting prevention recess 24 is formed at the center of the movable blade 22 provided in the movable member 20, and opposite ends of the movable blade 22 are inclined toward the central cutting prevention recess 24.

Accordingly, printer paper 300 is cut through engagement of the fixed blade 200 and the movable blade 22, the printer paper 300 may be completely cut or a portion of the printer paper 300 corresponding to the cutting prevention recess 24 is left according to an engagement degree of the cutting prevention recess 24 and the fixed blade 200.

Then, the movement distance of the movable member 20 is controlled as the guide boss 58 of the eccentric plate 50 is moved to one side or an opposite side of the guide hole 52 of the eccentric plate 50 according to forward or reverse rotation of the motor 30.

The movement distance of the movable member 20 is limited according to a distance between the guide boss 58 moved in the slot-shaped guide hole 52 and the coupling boss 54 to which the movable member 20 is coupled.

In the cutter structure of a printer according to the present invention, the movable blade 22 returns through manipulation of the lever 60 provided at one side of the housing 10 when the movable blade 22 of the movable member 20 is unintendedly engaged with the fixed blade 200 or the printer paper 300 is jammed.

A return gear 49 having saw-toothed gear teeth only at a portion of an outer peripheral surface thereof is installed on a lower side of the driven gear 48 to interlock with the rotary shaft of the driven gear 48, and a pressing piece 74 selectively attached to the return gear 49, for applying an external force to the gears on the outer peripheral surface of the return gear 49 is installed at one side of the outer peripheral surface of the return gear 49.

An attaching spring 76 is a torsion spring, and one end of the attaching spring 76 is attached to a guide wall 78 and an opposite end thereof is fixed to the body of the pressing piece 74 such that a resilient force is applied to the pressing piece 74 to allow the pressing piece 74 to be attached to the outer peripheral surface of the return gear 49.

A rotation member 70 having a bar shape and horizontally rotated by the medium of a central hinge is installed within the housing 10, and one end of the rotation member 70 is connected to the pressing piece 74 in a hinge structure and an opposite end thereof contacts an end of the lever 60.

The opposite end of the rotation member 70 contacting an end of the lever 60 is restricted and guided in a separation prevention guide 68 having an inverse stapler-shaped recess to be smoothly horizontally rotated.

Then, the guide wall 78 having an L-shaped planar shape, for performing a guide operation such that the pressing piece 74 is attached to an outer peripheral surface of the return gear 49 when the rotation member 70 is rotated according to manipulation of the lever 60 is formed on one side adjacent to a point where the rotation member 70 and the pressing piece 74 are connected to each other.

A return spring 72 corresponding to a torsion spring is installed at a central hinge of the rotation member 70, and the rotation member 70 rotated by an external force returns to an original position at the same time when the external force is removed.

The lever 60 installed at one side of the housing 10 is a known button for attaching or detaching the fixed blade 200 and the paper feeding roller 210 constituting an integral module, in which a body of the lever 60 is vertically rotated through a hinge coupling structure, a push part 62 for separating the fixed blade 200 and the paper feeding roller 210 is formed at one side of the lever 60, and a pressing part 66 for applying an external force while contacting an opposite end of the rotation member 70 is formed at an opposite end of the lever 60 so as to be inclined.

A lower portion of an outer peripheral surface of the return gear 49 is partially removed to form a detection part 49*a*, and a detection switch 80 is installed at one side of the detection part 49*a* such that the detection part 49*a* detects a rotation position of the return gear 49 and transmits a signal according to the detection to the controller.

Reference numeral 12 denotes a housing cover coupled to an upper surface of the housing 10 in which the motor 30, the gear unit, and the movable member 20 are installed to close an interior of the housing 10.

Next, an operation of the cutter structure of a printer according to the present invention will be described in detail with reference to the accompanying drawings.

According to the present invention, in order to cut printer paper when the printer paper 300 is discharged according to a printing operation of the printer in the state in which the printer 100 is configured by applying a cutting module having a mechanism of a specific structure, first, the motor 30 generates a forward or reverse driving force according to a control signal from the controller (not shown) of the printer, and accordingly, the driving force of the motor 300 is transferred to the eccentric plate 50 via the driving gear 40, the reduction gear 42, the shaft gear 44, the idle gear 46, and the driven gear 48 constituting the gear unit to rotate the eccentric plate 50 forwardly or reversely so as to interlock the eccentric plate 50.

Then, because the eccentric plate 50 is coupled to an upper surface of the driven gear 48 through the hinge pin 56 to move by the medium of the guide hole 52 and the guide boss 58, and the coupling boss 54 provided on an upper surface of the eccentric plate 50 is installed in the slot 26 of the movable member 20, a rotating force transferred from the motor 30 is provided to the movable member 20 as an external force for linear motion.

Accordingly, the movable member 20 is moved forward by a predetermined distance as the coupling boss 54 of the eccentric plate 50 is moved in the slot 26, and thus the movable blade 22 at the front end of the movable member 20 cuts the printer paper 300 located between the movable blade 22 and the fixed blade 200 while overlapping the fixed blade 200 at the position corresponding to the movable blade 22.

Then, the movable member 20 is controlled to reciprocate one time when the driven gear 48 is rotated one time according to driving of the motor 30, and the detection switch 80 installed adjacent the return gear 49 detects the corresponding position through the detection part 49*a* formed in the return gear 49 to transmit a signal to the controller of the printer.

Because the movable member 20 is designed such that a movement distance of the movable member 20 is controlled according to forward or reverse rotation of the motor 30, the location where the movable blade 22 and the fixed blade 200 overlap each other is adjusted under the control of the controller of the printer so that the printer paper 300 may be cut while a central portion of the printer paper 300 is left by the medium of the central cutting prevention recess 24 of the movable blade 22 or the printer paper 300 may be completely cut.

Meanwhile, when the fixed blade 200 and the movable blade 22 are unintendedly engaged with each other or the printer paper 300 is jammed in the process of cutting the printer paper 300 through movement of the movable member 20, the state may be released through manipulation of the lever 60 provided at one side of the printer 100.

That is, while the fixed blade 200 and the movable blade 22 are engaged with each other, the gear portion on the outer peripheral surface of the return gear 49 formed at a lower portion of the driven gear 48 is located at a point corresponding to the pressing piece 74.

Accordingly, if the user repeatedly presses the push part 62 of the lever 60, a pressing part 66 located on an opposite side of the push part 62 is raised through vertical rotation of the lever 60, and thus an external force is transferred to the rotation member 70 of which one side contacts the pressing part 66 such that the rotation member 70 is horizontally rotated and the external force is applied to the pressing piece 74 hinge-coupled to an opposite side of the rotation member 70.

Then, because an end of the rotation member 70 is restricted by the separation prevention guide 68 corresponding to a substantially inverse stapler-shaped groove, the rotation member 70 may be rotated while being stably guided in the groove.

The pressing piece 74 to which an external force is transferred through the rotation member 70 pushes the saw-toothed gear (see FIG. 7) formed at a portion of an outer peripheral surface of the return gear 49 to apply a rotating force while being attached to the outer peripheral surface of the return gear 49 through an operation of the guide wall 78 and the attaching spring 76.

Accordingly, the driven gear 49 is rotated through an operation of the pressing piece 74 as the lever 60 is repeatedly pressed, and then as the pressing piece 74 is located at a point where the return gear 49 has no gear portion through rotation of the driven gear 48, unintended engagement of the movable blade 22 and the fixed blade 200 may be released.

Thereafter, if the user completely manipulates the push part 62 of the lever 60, the rotation member 70 returns to an original position through an operation of the return spring 72 such that the pressing piece 74 remains separated from the outer peripheral surface of the return gear 49 by a predetermined distance.

Accordingly, through the cutter structure of a printer according to the present invention, when the cutter is unintendedly engaged or the printing paper 300 is jammed, the problem can be solved through a simple manipulation of the lever 60.

Even though other modifications may be made, they may be individually understood from the technical spirit or prospect of the present invention and fall within the scope of the present invention claimed in the claims.

DESCRIPTION OF REFERENCE NUMERALS

10: Housing
12: Housing cover
20: Movable member
22: Movable blade
24: Cutting prevention recess
26: Slot
30: Motor
40: Driving gear
42: Reduction gear
44: Shaft gear
46: Idle gear
48: Driven gear
49: Return gear
49*a*: Detection part
50: Eccentric plate
52: Guide hole
54: Coupling boss
56: Hinge pin
58: guide boss
60: Lever
62: Push part
64: Latching recess
66: Pressing part
68: Separation prevention guide
70: Rotation member
72: Return spring
74: Pressing piece
76: Attaching spring
78: guide wall
80: Detection switch
100: Printer
110: Receiving part
120: Discharge opening
200: Fixed blade
210: Paper feeding roller
300: Printer paper

The invention claimed is:

1. A cutter of a printer comprising:

a rectangular parallelepiped housing in which a paper feeding roller and a fixed blade integrally coupled to each other are detachably mounted to an upper portion of one side of the housing;

a plate-shaped movable member having a movable blade at one side thereof and having a slot at a center of a body thereof, the movable member provided at an upper side of the housing corresponding to the fixed blade such that the movable blade is engaged with the fixed blade while being selectively reciprocally moved by the movable member;

a motor fixedly installed within the housing, for receiving a control signal and generating a forward or reverse driving force;

a gear unit including a driving gear installed on a driving shaft of the motor, a reduction gear engaged with the driving gear, an idle gear engaged with a shaft gear at a lower portion of the reduction gear, and a driven gear engaged with the idle gear to interlock with the idle gear, wherein a guide boss is coupled to a central portion of the driven gear; and an eccentric plate having a substantially disk shape and coupled to an upper surface of the driven gear, the eccentric plate having a slot-shaped guide hole at a center thereof such that the guide boss passes through the guide hole, and the eccentric plate having a coupling boss coupled to the slot of the movable member for applying an external force to the movable member for reciprocal motion of the movable member and the movable blade.

2. The cutter of claim 1, wherein the guide boss is moved to one side or an opposite side of the guide hole of the eccentric plate as the motor is rotated forwards or reversely, and a movement distance of the movable member is controlled according to an interval between the guide boss moved in the slot-shaped guide hole and the coupling boss to which the movable member is coupled.

3. The cutter of claim 1, wherein the movable blade is returnable with respect to the fixed blade through manipulation of a lever at one side of the housing when the movable blade of the movable member is unintendedly engaged with the fixed blade, wherein a return gear, having saw-toothed gear teeth only at a portion of an outer peripheral surface thereof, is formed on a lower side of the driven gear so as to be interlocked with the driven gear, and wherein a pressing piece, having a sharp end biased by an attaching spring toward the return near for engaging the saw-toothed near teeth of the return gear, is installed adjacent an outer peripheral surface of the return gear, the pressing piece being connected to one end of a horizontally rotated bar-shaped rotation member, and the rotation member receiving a return force by a return spring such that an opposite end of the rotation member is engaged with a pressing part formed at an end of the lever so as rotate the rotation member to an angle against the force of the return spring to cause the movable blade to be returned.

4. The cutter of claim 3, including a guide wall having an L-shaped planar shape, for guiding the pressing piece such that the pressing piece is engaged with the return gear when the rotation member is rotated, the guide wall disposed adjacent a connection point of the rotation member and the pressing piece.

5. The cutter of claim 4, wherein a lower portion of the outer peripheral surface of the return gear does not have the saw-toothed gear teeth, and a portion of the lower portion of the outer peripheral surface of the return gear is removed to form a detection part, and wherein a detection switch for detecting a rotation position of the return gear and transmitting a signal is installed at a position adjacent the outer peripheral surface of the return gear so as to operatively cooperate with the detection part.

6. The cutter of claim 3, wherein a lower portion of the outer peripheral surface of the return gear does not have gear teeth, and a portion of the lower portion of the outer peripheral surface of the return gear is removed to form a detection part, and wherein a detection switch for detecting a rotation position of the return gear and transmitting a signal is installed at a position adjacent the outer peripheral surface of the return gear so as to operatively cooperate with the detection part.

* * * * *